United States Patent [19]

Wehrman

[11] 4,226,105

[45] Oct. 7, 1980

[54] KEY RING HOLDER

[76] Inventor: Floyd L. Wehrman, Apt. 220, 8477 Regent Ave. North, Minneapolis, Minn. 55443

[21] Appl. No.: 904,856

[22] Filed: May 11, 1978

[51] Int. Cl.[2] ..... A44B 15/00

[52] U.S. Cl. ..... 70/456 R; 24/3 K; 24/3 M; 24/264; 224/253; 224/269; D3/61

[58] Field of Search ..... 24/3 K, 3 M, 198, 237, 24/264, 130, 236, 73 C; 224/5 R, 5 A, 26 R, 26 K, 27, 252, 253, 255, 269; 70/456 R, 457–459; D2/400; D3/61, 62

[56] References Cited

U.S. PATENT DOCUMENTS

| | | | |
|---|---|---|---|
| 279,206 | 6/1883 | Van Altena | 24/73 C X |
| 927,275 | 7/1909 | Parker | 24/264 X |
| 1,326,011 | 12/1919 | Anagnostopoulos | 24/3 K |
| 1,339,631 | 5/1920 | Smith | 24/3 K |
| 1,412,011 | 4/1922 | Böhm | 24/3 K |
| 1,414,816 | 5/1922 | Killion | 24/3 M |
| 1,475,974 | 12/1923 | Torrey | 24/3 M |
| 1,477,680 | 12/1923 | Zetlin | 24/3 M |
| 1,484,991 | 2/1924 | Jalbert | 24/3 K |
| 1,571,425 | 2/1926 | Mataloni | 70/459 |
| 1,578,157 | 3/1926 | Miller | 24/3 K |
| 1,678,016 | 7/1928 | Menke | 24/3 K X |
| 1,797,098 | 3/1931 | Minehart | 24/3 K |
| 1,987,531 | 1/1935 | Huntington, Jr. | 24/73 C |
| 2,033,701 | 3/1936 | Gibbs | 24/236 |
| 2,071,757 | 2/1937 | Matthews | 24/3 K X |
| 2,595,700 | 5/1952 | Plough | 70/459 |
| 2,605,944 | 8/1952 | Maurice | 24/3 K X |
| 2,694,844 | 11/1954 | Grumbach, Jr. | 70/459 X |
| 3,357,615 | 12/1967 | Hill | 224/255 |
| 3,992,776 | 11/1976 | Koppe et al. | 224/253 X |
| 4,113,156 | 9/1978 | Brito | 224/269 X |

FOREIGN PATENT DOCUMENTS

| | | | |
|---|---|---|---|
| 432948 | 1/1926 | Fed. Rep. of Germany | 70/456 R |
| 333203 | 11/1903 | France | 24/237 |
| 92222 | 9/1968 | France | 224/26 K X |
| 507060 | 12/1954 | Italy | 24/3 K |
| 101811 | 10/1916 | United Kingdom | 24/3 K |

OTHER PUBLICATIONS

"Keys Can Be Selected Quickly When Spaced on Chain;" p. 138 from *Popular Mechanics,* Issue date only known as prior to 1950.

*Primary Examiner*—Roy D. Frazier
*Assistant Examiner*—Carl F. Pietruszka
*Attorney, Agent, or Firm*—Kinney, Lange, Braddock, Westman and Fairbairn

[57] ABSTRACT

A key ring holder of the type designed to be supported by a belt, including an elongated loop member adapted to surround and be retained by a belt, the loop member having secured thereto an eye which projects outwardly from the loop member and which carries a spring clip for holding a key ring spaced outwardly from the body of the wearer. The outer wall of the loop member preferably diverges outwardly from the inner wall from the top to the bottom so that it can be used for belts of different thicknesses. In one form, the ring may have secured thereto by means of a flexible wire a second ring so as to permit dividing the keys into two groups each of which is carried by a separate ring.

5 Claims, 4 Drawing Figures

KEY RING HOLDER

BACKGROUND OF THE INVENTION

It is very well known to provide a key ring holder in which a key ring is carried by a loop which is designed to surround a belt and be retained thereby. There are a number of drawbacks, however, to known key ring containers of this type. For instance, it is customary for the key ring to be suspended below the belt loop with the result that the keys secured to the ring tend to rub against the clothing. Eventually, this will result in the clothing showing signs of wear due to the abrasive effect of the keys. Another drawback to many of the prior arrangements is that the loop surrounding the belt is rather readily detachable therefrom and can either be accidentally separated from the belt or can be removed without the wearer's knowledge by one wishing access to the keys carried by the key ring. A further drawback to the prior arrangement is that because the loop that fits around the belt is detachable, it is normally very difficult to provide an ornamental appearance to the key ring holder.

SUMMARY OF THE PRESENT INVENTION

The present invention is concerned with a key ring holder in which there is an elongated loop member designed to have a belt passed through it for support of the loop member by the belt, an eye member secured to the loop member in such a way that the eye member extends outwardly and downwardly from the outer wall of loop member, and a spring hook suspended from the outermost portion of the eye member so as to be spaced transversely from the inner wall of the loop member and hence from the body of the wearer, this spring hook being adapted to receive a key ring upon yieldable opening of the hook.

The eye member is preferably secured to the loop member by a shank which is disposed angularly with respect to the center plane of the eye member and extends along the bottom wall of the loop member parallel thereto.

The outer wall of the loop member preferably diverges outwardly from the inner wall proceeding from top to bottom so that when a belt is inserted into the loop member, the upper portion of the loop member will engage the belt regardless of the thickness of the belt.

It is desirable that the loop member be formed as a closed loop which can be withdrawn from the belt only by longitudinal movement thereof off of the end of the belt.

The spring hook preferably has a depressable spring latch which is wider than the other elements of the hook to facilitate ready manipulation thereof to latch open position to permit quick detachment of the key ring from the holder by the user.

The outer wall of the loop member may be wider than the inner wall and have suitable ornamentation thereon.

The key ring holder may be provided with pair of key rings connected by a rod of relatively small diameter, each of the rings being adapted to have keys secured thereto and one of the rings being secured to the spring hook. The rod may be a section of flexible steel wire which has loops secured thereto for retaining the rings.

Other features and objects of the invention will be apparent from the consideration of the accompanying specification, claims and drawings.

DESCRIPTION OF THE PREFERRED EMBODIMENTS

Figures 1, 2, 3, 4:
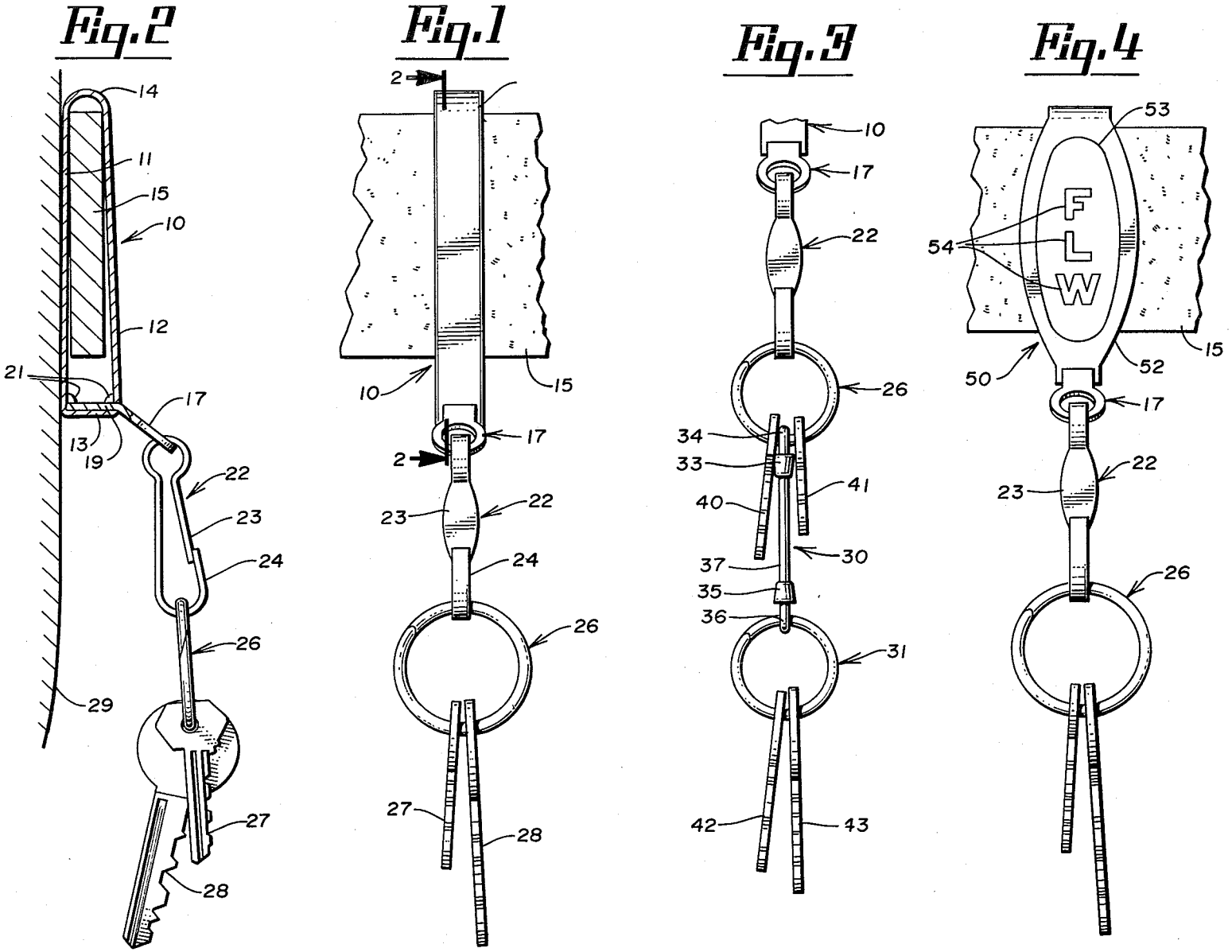
FIG. 1 is a vertical elevational view of my key ring holder secured to a belt with a fragmentary portion of the belt being shown.
FIG. 2 is a side view of my key ring holder, a portion thereof being shown in section, the section being taken along line 2—2 of FIG. 1.
FIG. 3 is an elevational view of the modified portion of a modification of the key ring holder of FIG. 1.
FIG. 4 is an elevational view of another modification of my key ring holder.

Referring first to FIG. 1, the preferred key ring holder includes a loop member 10 which as best shown in FIG. 2, has a back wall 11, a front wall 12, a bottom wall 13 and a top curved wall 14. The loop member 10 is preferably formed out of a sheet of metal which is bent to provide the top wall 14, the back wall 11, the front wall 12 and the bottom wall 13, the abutting edges being secured thereto as by welding. On the other hand, the unit can be made out of seamless tubular stock which is bent to have the cross-sectional configuration of FIG. 2. In any event, it is preferable that the loop member 10 be a closed loop having no openings in its sidewalls.

As best shown in FIG. 2, the wall 12 diverges outwardly from the rear wall 11 proceeding from the top to the bottom. The reason for this is that the loop member 10 is designed to fit over a belt 15 only a portion of which is shown in plan view and FIG. 1 and which is shown in section in FIG. 2. As will be clearly evident from FIG. 2, the loop member 10 has a vertical dimension somewhat greater than that of the belt 15 so that the loop member can be freely moved over the belt member 15 when the loop member is raised up slightly. When the loop member is then dropped down, the belt member is gripped between the back wall 11 and the front wall 12. Furthermore, because of the diverging walls 11 and 12, it is possible to accomodate belts of different thicknesses. While the loop member 10 is designed to receive belts of different widths, it is well to have a loop member of a vertical depth approximately corresponding to the key ring holder which is to be used. For example, in the case of a two inch belt, a loop member having a vertical height of from two and one-eighth to two and a quarter inches is desirable.

Secured to the bottom wall 13 of the loop member 10 is an eye member 17. This member preferably has a flat shank 19 which is disposed at an angle with respect to the plane of the eye member 17. It is preferably rigidly secured to the bottom 13 of the loop member 10 in any suitable manner, as by welding, as indicated by the reference numeral 21. It will be noticed that the eye member extends downwardly and outwardly from the loop member 12. This is a very important feature of my invention since, as will be described in more detail later, and is clearly apparent from FIG. 2, the disposition of the eye member 17 in this manner insures that the key ring will be spaced outwardly from the body. While the shank 19 is preferably flat, as shown, the eye member 17 may be formed of a member of circular cross-section, in which case the shank will have a circular cross-section.

Secured to the loop of the eye member 17 is a spring hook 22. This spring hook is of a common type having a yieldable spring latch 23 which is normally biased outwardly into engagement with a leg 24 of the spring, but which can be depressed to separate the spring latch 23 from the leg 24 to permit the insertion of a key ring.

The key ring is designated by the reference numeral 26 and is of conventional form. Such key rings conventionally take the form of a split ring on which the keys may be threaded. Keys 27 and 28 are shown as secured to the key ring 26. It is, of course, understood that any desired number of keys may be secured to the ring 26.

In FIG. 2, I have shown the belt 15 as associated with the body of a wearer, the outline of which is represented by the line 29. It will be apparent that, because of the disposition of the eyelet 17, the fastener 22 is held at a substantial distance from the body 29. This means that the ring 26 and the keys 27 and 28 tend to be spaced outwardly from the body. This has two advantages. Not only does it mean that the keys do not rub against the clothes of the wearer and cause abrasion, but also the location of the key outwardly from the body enables the wearer to more quickly detach the key ring 26 from the spring clip 22. When it is desired to detach the key ring 26, all that it is necessary to do is to push inwardly on the spring latch 23, separating it from the leg 24 so that the ring can be readily removed between the leg 24 and the spring latch 23. Since the ring 26 is spaced outwardly from the body, it is very easy to do this. Because the spring latch 23 is somewhat wider than the remaining portion of the spring hook, the spring latch 23 can be readily engaged and depressed to facilitate removal of the ring 26.

MODIFICATION OF FIG. 3

It is often desirable to have keys divided between two rings. This enables them to be classified according to the uses to which they are to be put. For example, one set of keys may fit the locks for the automobile and another set of keys may fit the locks at home. Arrangements are known for providing a detachable ring for retaining certain keys to permit them to be readily separated from the rest of the keys when, for example, an automobile is being left at a repair shop. These detachable rings, however, often result in accidental detachment of the ring from the main ring. In the modification of FIG. 3, I provide two separate rings which are held together, but provide the flexibility of independent rings although they cannot be removed from each other.

Referring specifically to FIG. 3, the same reference characters have been used for elements similar to those in FIGS. 1 and 2. Thus, the spring clip 22 is secured to an eye 17 which, in turn, is fastened to a loop member 10 in the same manner as in FIGS. 1 and 2. Since the loop member is the same as in FIGS. 1 and 2, only a fragmentary portion of it is shown in FIG. 3. Similarly, a ring 26 is secured to the spring clip 22 just as in FIGS. 1 and 2. Fastened to the ring 26 is a link member 30, preferably formed of a flexible steel wire. At one end, the wire has secured thereto by means of a molded plug 33, a loop 34 which is designed to be secured on the ring 26 in the same manner as the keys are secured thereto. The molded plug 23 can be of any suitable metal which will firmly retain the loop 34 in position and prevent detachment thereof from the remainder of the link member 30. At the opposite end of the link member 30, there is also another similar molded plug 35 to which is secured a second loop 36 which surrounds a ring 31, being secured thereon in the same manner as are the keys. I have shown keys 40 and 41 as secured to ring 26 and keys 42 and 43 as secured to ring 31. Keys 40 and 41 might, for example, be used in connection with the locks of the home while keys 42 and 43 might be used in connection with the automobile locks.

Because of the flexibility of wire 39, it is possible to use the keys on either ring without interference from the keys on the other ring. Because the wire 39 is permanently attached to the loops 34 and 36, there is no chance for accidental detachment of ring 31 from ring 26 or from the key ring holder.

MODIFICATION OF FIG. 4

One of the drawbacks of many key retainers of the type worn on the belt is that these key retainers are relatively unsightly. This is partly due to the fact that, in most cases, the loop member is removable from the belt by the release of some fastening means and the presence of such fastening means makes it difficult to make the loop member attractive in appearance. Because the loop member surrounding the belt is a closed loop member, it is possible with the key ring holder of the present invention to provide an ornamental loop member. Such an arrangement is shown in FIG. 4 in which all of the elements with the exception of the loop member correspond to elements in FIGS. 1 and 2 and have the same reference characters applied thereto. In the present case, the loop member is designated by the reference numeral 50. This loop member is secured to a belt 15 just as in FIGS. 1 and 2 and its cross sectional appearance is the same basically as in FIG. 2. In other words, it will have front and rear walls which diverge from each other proceeding from top to bottom. The difference is that the front wall 52 is generally oval shaped. It may be silver plated or gold plated to improve its appearance. Secured in the central portion of the front wall 52 is an oval portion 53 which may, for example, be of baked enamel. This center oval portion may have a pictorial scene or, as indicated in the drawing, it may have letters 54 applied thereto. These letters, for example, may be the initials of the wearer.

It will be readily apparent that a loop member such as that shown in FIG. 4 can be extremely attractive in appearance. It is also to be understood that the eye 17 and the spring hook 22 can be silver or gold plated to enhance their appearance also.

CONCLUSION

It will be seen that I have provided an extremely simple key ring holder in which the keys are carried by a loop member fastened to the belt in such a manner that the belt loop cannot be removed from the belt. Furthermore, the keys are carried in such a manner that they are spaced outwardly from the body of the wearer so as to decrease the wear on the clothing produced by the keys and also to facilitate the removal of the key ring from the key ring holder.

While I have shown certain specific embodiments of my invention, for purposes of illustration, it is to be understood that the scope of the invention is limited solely by that of the appended claims.

I claim:

1. A key ring holder comprising:

an elongated closed loop member designed to have a belt passed therethrough for support of said loop member by the belt and which can be withdrawn from the belt only by longitudinal movement thereof off of the end of the belt; said loop member having inner and outer walls joined by top and bottom walls and spaced apart sufficiently to accommodate a belt therebetween and of a length sufficiently great to provide for the full width of such a belt within said loop member, said outer wall of said loop member diverging outwardly from said inner wall from top to bottom;

an eye member having a shank extending along and secured to the bottom of said loop member and an eye portion, said eye portion extending outwardly from said shank in such a manner to extend outwardly and downwardly from the outer wall of said loop member with the entire eye portion being disposed beyond said outer wall;

and a spring hook suspended from the outer lowermost portion of said eye member so as to be spaced transversely from the inner wall of said loop member and hence from the body of the wearer, said spring hook being adapted to receive a key ring upon yieldable opening of said hook.

2. The key ring holder of claim 1 in which said spring hook has a depressible spring latch which is wider than the other elements of said hook to facilitate ready manual manipulation thereof to latch open position to permit quick detachment of the key ring from the holder.

3. The key ring holder of claim 1 in which the outer wall of the loop member is wider than the inner wall and has ornamentation thereon.

4. In combination with the key ring holder of claim 1, a pair of key rings and a link of relatively small diameter connecting said rings, each of said rings being adapted to have keys secured thereto and one of said rings being secured to said spring hook.

5. The combination of claim 4 in which said link is a section of flexible steel wire having loops secured thereto and retaining said rings.

* * * * *